US005247884A

United States Patent [19]

Rid

[11] Patent Number: 5,247,884

[45] Date of Patent: Sep. 28, 1993

[54] METHODS AND APPARATUS FOR FORMING PRINTING CYLINDERS, AND THE RESULTING BALLARD SHELLS AND PRINTING ROLLS

[75] Inventor: Max Rid, Naperville, Ill.

[73] Assignee: K. Walter Service Corporation, Downers Grove, Ill.

[21] Appl. No.: 805,369

[22] Filed: Dec. 10, 1991

[51] Int. Cl.[5] ..... B41F 13/10

[52] U.S. Cl. ..... 101/375; 101/401.1; 205/151; 492/47; 492/54

[58] Field of Search ..... 101/150, 170, 375, 395, 101/401.1; 205/921, 127, 151, 50, 143, 69, 70, 118; 29/123, 129.5, 110

[56] References Cited

U.S. PATENT DOCUMENTS

| | | | |
|---|---|---|---|
| 52,615 | 2/1866 | Smith | 29/123 X |
| 1,643,046 | 9/1927 | Ballard | 101/170 X |
| 1,831,645 | 11/1931 | Ballard | 101/150 X |
| 1,884,512 | 10/1932 | Ballard | 205/151 X |
| 1,918,627 | 7/1933 | Ballard | 205/151 X |
| 2,155,392 | 4/1939 | Ballard | 205/143 X |
| 2,208,729 | 7/1940 | Offutt | 29/129.5 X |
| 2,639,751 | 5/1953 | Flaherty | 150/166 |
| 2,724,660 | 11/1955 | Ingalls et al. | 427/105 |
| 2,787,956 | 4/1957 | Kirby et al. | 101/375 |
| 2,817,940 | 12/1957 | Lorig | 29/123 X |
| 2,840,039 | 6/1958 | Darnell et al. | 118/505 |
| 2,935,936 | 5/1960 | Woodring et al. | 101/128.1 |
| 3,138,848 | 6/1964 | Cheney | 29/123 |
| 3,161,125 | 12/1964 | Hornbostel | 29/123 X |
| 3,449,965 | 6/1969 | Ross | 74/18.1 |
| 3,451,903 | 6/1969 | Matsuoka | 205/50 |
| 3,480,894 | 11/1969 | Joyce | 335/303 |
| 3,665,355 | 5/1972 | Sasaki et al. | 335/306 |
| 3,668,752 | 6/1972 | Clifton et al. | 29/124 |
| 3,837,959 | 9/1974 | Bishop | 156/246 |
| 3,887,421 | 6/1975 | Hudson et al. | 156/280 |
| 3,924,212 | 12/1975 | Brown | 335/303 |
| 3,927,943 | 12/1975 | Pohl et al. | 355/132 |
| 4,029,013 | 6/1977 | George et al. | 101/389.1 |
| 4,340,450 | 7/1982 | Saito | 205/136 |
| 4,507,332 | 3/1985 | Nolan et al. | 427/67 |
| 4,764,259 | 8/1988 | Itou et al. | 205/143 |

FOREIGN PATENT DOCUMENTS

| | | | |
|---|---|---|---|
| 273961 | 12/1986 | Japan | 101/150 |
| 2034636 | 6/1980 | United Kingdom | 101/150 |

*Primary Examiner*—Eugene H. Eickholt

*Attorney, Agent, or Firm*—McAndrews, Held & Malloy, Ltd.

[57] ABSTRACT

A method of forming a Ballard shell on a rotogravure printing roll or the like. At least one of the side surfaces of a roll base is covered with a removably fixed, adhering, concentric, annular disk which remains in place and limits the radial extent of plating on the side of the cylinder while a Ballard shell is plated on the roll. The disk is removable from the roll at the end of the process. The result of the process is a novel Ballard shell having a cleanly terminating inner circumference adjacent to the roll and a ledge portion on its inner periphery extending axially outward from the inner circumference. The axially extending ledge portion of the Ballard shell is a novel structural feature, and is responsible for the easy stripability of the shell after an extended printing run. Yet another aspect of the invention is a rotogravure roll or the like on which a Ballard shell having the previously described construction is formed. Still another aspect of the invention is an annular disk having a first major surface which can be made of polymeric magnetic material and a second major surface which can be made of electrically non-conductive polymeric material. In one specific embodiment, the disk can be opened to slip the disk over a shaft from the side and then rejoined to encircle the shaft.

5 Claims, 2 Drawing Sheets

METHODS AND APPARATUS FOR FORMING PRINTING CYLINDERS, AND THE RESULTING BALLARD SHELLS AND PRINTING ROLLS

The present invention relates generally to methods and apparatus for plating copper and chrome on the outer cylindrical surface of a rotogravure printing roll or the like, and particularly to methods and apparatus for plating a Ballard shell on the roll. The present invention also relates to Ballard shells, to apparatus for forming Ballard shells, and to printing rolls clad with removable Ballard shells.

BACKGROUND OF THE INVENTION

The image carrier in rotogravure printing is the cylindrical copper outer surface of a printing roll or gravure cylinder. The image carrier is engraved or etched with an image made up of small depressions, called cells, which hold ink. The image and its carrier are protected against the abrasion of the doctor blade in the printing press by a plated chrome layer. The ink selectively retained by the cells of the image is transferred onto a web of paper or another substrate in a rotogravure printing press.

The base of the gravure cylinder is the physical structure which receives and supports the image carrier. Most cylinder bases are made completely of steel. Steel can be machined accurately and plated with other metals rather easily.

Copper is the dominant image carrying surface material for gravure cylinders. Copper is applied to the steel cylinder in three steps. First, an initial flash (an adhesive layer only a few microns thick) of copper is plated to the steel with a cyanide electrolyte. As an alternative, the steel base can be plated with a nickel layer. Nickel plating tanks need more attention to achieve good results. Next, an underlying "base copper" layer 0.5 mm to 1.0 mm thick is electroplated onto the base with a sulfuric acid based electrolyte. Finally, the engraving surface, which serves as the image carrier, is electroplated on the base copper, again using a sulfuric acid based electrolyte.

An exemplary base copper layer has a diameter 160 to 200 microns (0.0063 to 0.008 inches) below printing diameter. The base copper layer should have as good a finish as the subsequently applied engraving layer. The base copper can be prepared either with a lathe and grinder or a machine tool.

The type of image carrier particularly relevant here is called a Ballard shell. A Ballard shell is a plated copper shell about 0.004 inches (0.10 mm.) thick which is removably clad on the outside of a gravure printing roll, over the base copper. A printing image is engraved into the Ballard shell and covered with a protective plated chrome layer. The roll clad with the Ballard shell is then used for printing in a rotogravure press. When the printing image is no longer needed, the printing roll can be recycled by manually stripping the used Ballard shell from the roll, then applying a new Ballard shell to the roll in its place.

Base copper preparation is only done once at the beginning of the Ballard shell process and has to be repeated only if the cylinder is damaged mechanically during transportation or correction. Since base copper preparation is not a regular task in the Ballard shell process, speed is not a concern. The quality of the base, however, is important, because the base serves as starting point for all of the subsequent plating operations. Once the base is prepared, the regular Ballard shell production can begin. The Ballard shell process is well known in the art.

The Ballard shell is a very simple process technology when the correct procedures are followed, yet the quality of its results is rather sensitive to changes in process variables and to changes in the quality of the copper base.

The Ballard shell was developed by Ernest G. Ballard in the 1920's and is therefore one of the oldest process technologies in gravure cylinder making. In all operations where cylinders frequently receive new engravings the Ballard shell has considerable advantages, because it eliminates machining time. The Ballard shell gained widespread popularity in both publication and packaging printing. With the technology available then, however, the real problems of the Ballard shell process could not be solved.

Today the pendulum is swinging back in favor of the Ballard shell. In Europe, the Ballard shell is presently seeing an enormous revival both in publication and in packaging printing. In Japan all of the major publication and packaging printers never switched away from the Ballard shell, because with their high production volumes base copper technologies were not cost efficient. In the U.S. the Ballard shell has many supporters that never stopped using it and is finding new ones again.

The Ballard shell process has several clear advantages. It is the process that requires the least investment in equipment and the least space (a preparation sink, a copper plating tank, and a polisher are enough to start). The meticulous washing of cylinders is of no concern for the Ballard shell process. Since the chrome layer is stripped together with the copper layer, ink rests do not affect the quality of the process. Use of the Ballard shell process eliminates the necessity of dechroming every cylinder and therefore reduces the need to treat effluent containing chrome in the waste water treatment plant. Furthermore, with the exception of the manual stripping work, the Ballard shell process is very easy to automate, thus eliminating all labor besides stripping and improving capacity and turnaround time. Finally, the Ballard shell process uses thin copper layers which keep copper plating times low.

A principal disadvantage of the Ballard shell process is that manual work cannot be totally eliminated, which poses a problem if the work flow of a whole plating department is to be fully automated.

A Ballard shell is stripped from a printing roll by opening the side or inner periphery of the Ballard shell that is plated over the side of the cylinder with a putty knife or a similar sharp object. After the side of the shell is opened, two stripes of copper are pulled across the cylinder like a zipper, and then the whole shell falls off the roll. The hardest part of stripping a Ballard shell is getting the first piece loosened on the cylinder side. The shell can be opened easily with a putty knife only if its inner periphery terminates abruptly at an edge which is easily engaged by a putty knife or a similar tool.

A first technological challenge of the Ballard shell is to plate an engraving copper layer that does not adhere to the base, and yet is fixed firmly on the roll so it will not come off prematurely in the press. A second challenge is to plate a Ballard shell that is soft and malleable enough so it can be stripped off, and yet is hard enough to be engraved electromechanically.

The preparation for plating a Ballard shell is a regular degreasing process with the additional process of applying the separation layer. The separation layer is either manually poured over the cylinder or automatically sprayed on. Separating solutions can be based on mercury, nickel, silver or protein.

The Ballard shell of the gravure cylinder is etched with ferrous chloride or electromechanically engraved to provide the image to be printed. After that, the image carrier is almost always covered with a thin electroplated layer of chrome (about 6 microns or 0.00023 inches thick) which protects the engraving. The chrome layer is added because the copper alone would not withstand the friction of the doctor blade for the long printing runs normally encountered.

The type of chrome that is used for rotogravure has a high hardness of around 1100 Vickers. This compares with a copper hardness of around 200 Vickers (hard copper for electromechanical engraving). Chrome also has a low coefficient of friction, and the ink carried by the chrome surface also serves to lubricate the doctor blade so that little abrasion is produced. A chrome plated engraved copper cylinder can run for millions of revolutions without wear and without changing the cell shape at all.

The plating tanks for electroplating a gravure cylinder with copper and chrome consist of anodes and an electrolyte trough that is chemically and electrolytically resistant to the electrolyte. The cylinder is the cathode (except when the current is briefly reversed in the copper plating bath). The cylinder and the anodes are connected to a rectifier that supplies the necessary DC current for plating. Both the cylinder surface and the anodes are immersed in a bath of the electrolyte carried in the trough. The plating tank has to be designed to control the process in a way that the desired reactions take place and the undesirable reactions are suppressed.

The immersion factor describes what percentage of the cylinder surface is immersed in the electrolyte at any point in time and is therefore available as an active surface which can receive plating. The higher the immersion factor, the faster the potential speed of the tank, because more current can be conducted through the large surface. A higher immersion factor normally also requires a larger anode and has an impact on plating tank design because of sealing requirements.

Current density is the amount of current flowing divided by the active area. The higher the current density for a given immersion factor, the faster the plating speed. The distance between the nearest anode and a point of the cylinder has a strong impact on the resistance at that point. The smaller the distance, the smaller the resistance at that point. Most modern copper and chrome plating tanks run with small anode/cathode distances, for example, from about one to two inches (25–51 mm.).

Contaminants of the electrolyte will be built into the copper or chrome surfaces along with the intended ions. They change the structure and characteristics of the plate, mostly in undesirable ways. Once attached to the cathode surface, they change the electric field in that area and lead to growth of "pimples" or "comets" that create problems in all further operations.

In particular, iron can enter the electrolyte when a ferrous surface of the cylinder is exposed to the plating bath, particularly if the current in the plating tank is reversed briefly just before plating is commenced, which is commonly done.

In every plating tank the cylinder has to be supported, driven, cathodically contacted and sometimes sealed. These tasks are carried out by the adapter system, which consists of the actual adapter for the cylinder and the clamping system in the tank. Adapters come in wide varieties, ranging from large screw-on current transfer adapters to small slide-on bushings to completely adapterless systems. Adapterless tanks are typically more expensive and need more maintenance than simple tanks, but they can save large amounts of labor. The decision for a specific adapter system has to be made in conjunction with the decision for the overall level of automation in the whole line.

All modern copper and chrome plating tanks have a horizontal design with adapter systems. They come with immersion factors ranging from under-shaft to full immersion.

According to one common method of forming a Ballard shell, the shell is plated using an under-shaft immersion tank which runs without seals. The cylinder is disposed horizontally and supported by its shaft in the tank so that the outer surface of the cylinder is immersed in the plating electrolyte to a depth not quite great enough to allow the electrolyte surface to touch the cylinder shaft. The cylinder is rotated during the plating process by turning its shaft to evenly plate the entire circumference of its outer surface. Since the sides of the cylinder are immersed in and not protected from the electrolyte, the wetted surface of each side is also plated in an annular pattern which extends radially inward to an inner periphery representing the depth of immersion of the cylinder side.

When the copper Ballard shell is plated on the cylinder in this manner, the thickness of the copper shell tapers off gradually between the outer edge and the inner periphery of the side of the cylinder. This characteristic taper occurs because the current density at a given point of the side, and thus the thickness of the shell at that point, is inversely proportional to the distance between the point and the anode. The inner periphery of the Ballard shell thus does not terminate abruptly at a sharp, thick edge, but tapers down to a feathered edge. In this case the shell is hard to open and the cylinder sides are liable to be scratched when a worker struggles to open the shell.

The inner periphery of the shell can be improved by painting the cylinder sides with acid resistant lacquer before the shell is plated. The lacquer is painted up to a distance of 10 mm to 25 mm below the edge of the cylinder. The copper now plates down to where the lacquer starts. The lacquer, however, does not have a specific thickness, so the copper cannot plate a ledge to it. A steep tapered ending is formed by the plating process. This steep tapered ending is much easier to open than when nothing is done, but a better ending would be far easier to open. In addition applying and removing the lacquer is labor intensive work.

In all plating tanks with higher immersion factors (up to 90%) the cylinder shafts are covered with polypropylene (or similar material) tubes with rubber sealing gaskets pressed against the cylinder sides. These sealing tubes are either put on manually or are built into the tank and move in automatically. Ideally, a different diameter tube is used for different cylinder diameters. The rubber gasket defines how far the copper plates down the side. The seal also acts somewhat as a current deflector, so the edge for the shell is tapered. It is much better to open the shell if sealing gaskets are used than if nothing is done, but still the opening operation is not optimal.

In all plating lines that are fully automated, the adapterless tanks with automatic sealing designs have a problem. The sealing diameter of the automatic seal necessarily corresponds to the smallest diameter of any cylinder that is processed in the line. This means that all other cylinders basically have the same problems as if nothing was done to create an edge.

SUMMARY OF THE INVENTION

One object of the invention is to provide an improved process for forming Ballard shells.

Another object of the invention is to provide improved apparatus for forming Ballard shells.

An additional object of the invention is to provide Ballard shells which are more easily strippable than before.

Still another object of the invention is to provide a simple, inexpensive mask which can be placed on each end of a roll before a Ballard shell is applied, and which will pass through the entire plating process, then be easily removed to expose the edge of the Ballard shell.

Yet another object of the invention is to provide masks of different diameters, so optimized Ballard shells and base copper layers can be formed on gravure rolls having different diameters without otherwise changing the plating process.

A further object of the invention is to provide a gravure cylinder having a Ballard shell which will stay on the roll during an extended printing run, and yet is easily strippable after the run when the roll is to be recycled.

Another object of the invention is to provide a defined sealing diameter on the ends of a printing roll which is being plated in a chrome plating tank.

One or more of the preceding objects, or one or more other objects which will become plain upon consideration of the present specification, are satisfied by the invention described herein.

One aspect of the invention is a method of forming a Ballard shell in which at least one of the side surfaces of a gravure roll base is covered with a removably fixed, adhering, concentric, annular disk which remains in place while a Ballard shell is plated on the roll. The disk has first and second major surfaces, an inner circumference defining an opening, and an outer circumference defining a plating limit on the side surface of the roll.

The roll equipped with the present annular disk is dipped, with its axis held substantially horizontal, into the surface of a Ballard shell plating bath. In an undershaft immersion process, the roll is dipped to such a depth that the surface of the bath lies entirely below the inner circumference of the annular disk and above an arc of the outer circumference of the annular disk. The roll is rotated about its axis while maintaining conditions in the bath suitable for plating a Ballard shell on the rotating roll. The disk is removable from the roll at the end of the process, although it can also be left in place until after the roll is used for a printing run, providing the disk is resistant to the printing ink vehicle and the conditions of printing.

A significant advantage of this process is that the resulting Ballard shell has an axially extending ledge which abuts the outer circumference of the annular disk. Once the disk is removed, the ledge at the periphery of the shell can easily be engaged with a putty knife or the like to release the Ballard shell from the roll. Thus, the shell is far easier to remove than was previously the case.

Another advantage of this process is that the disk can be inexpensively made, can be reusable, and is very compact. A wide variety of disks having different inner and outer diameters can be economically kept on hand for rolls having different shaft and outside diameters. The disks can be applied while the rolls to be plated are in storage, so the roll handling process from storage through plating can be automated when the disks are used.

Yet another advantage of this process is that the disk can be sized to overlap the periphery of the base copper of the roll. The use of a disk of sufficient size prevents the steel base of the roll from being exposed to the plating solutions, which otherwise can become contaminated with iron.

Another aspect of the invention is a novel Ballard shell. The shell has a cylindrical portion, a substantially annular intermediate portion extending inwardly in a generally radial plane from the cylindrical portion to an inner circumference, and an axially extending ledge portion. The ledge portion optionally has axially extending fingers at its outer edge which abut the outer circumference of the disk when the shell is plated. The ledge portion is a novel structural feature of the Ballard shell, and is the feature responsible for the easy stripability of the shell after an extended printing run.

Yet another aspect of the invention is a roll comprising a substantially cylindrical outer surface; an side surface; and a Ballard shell made of plated metal. The shell has the features just described.

Still another aspect of the invention is an annular disk having first and second major surfaces, an inner circumference defining an opening, and an outer circumference. The first major surface can be made of polymeric magnetic material and the second major surface can be made of electrically non-conductive polymeric material. In one specific embodiment, the disk has an inner circumference defining an opening, an outer circumference, and separable first and second edges defined by and substantially abutting at a parting line extending from the inner circumference to the outer circumference. In that particular embodiment, the first and second edges may define, respectively, a tab and a mating recess which can be parted to slip the disk over a shaft from the side, then joined to encircle the shaft.

The present Figures are not drawn to scale.

DETAILED DESCRIPTION OF THE INVENTION

While the invention will be described in connection with one or more preferred embodiments, it will be understood that the invention is not limited to those embodiments. On the contrary, the invention includes all alternatives, modifications, and equivalents as may be included within the spirit and scope of the appended claims.

The novel apparatus used to practice the present invention consists of one or more disks, each preferably made of flexible magnetic material with an electrically non-conductive plastic backing. The disks are attached to one or both sides of a gravure printing cylinder during the plating process in a copper or chrome plating line.

The magnetic disks come in two versions: a closed ring and an openable ring with a "puzzle type" lock. The closed ring can be used in all plants where cylinders are set down on the cylinder faces before and after plating, leaving the end shafts of the roll accessible. The openable ring can be used in plants where cylinders rest on their shafts before or after plating, so that a closed ring cannot be slid over the shaft. In the later case a "puzzle type" lock is important, because otherwise the ring might be peeled off during plating due to friction of the electrolyte.

The inner diameter of the ring has to be big enough to slide over the shaft of the cylinder and to hit the cylinder side outside any radius that forms the transition from the side to the shaft. The outer diameter is preferably the optimum diameter to which the plating tank should plate on the cylinder side. The inner diameter is, therefore, always the same for cylinders of a specific design. The outer diameter may vary, because different print jobs are printed with cylinders of different diameters and the optimum sealing diameter is different in copper and chrome tanks. (The chrome layer should not come further down on the side than the copper layer).

The invention can provide a Ballard shell with a sharp edge better than any other method used today. The disk can be sized to have an outer radius from about 10 mm to about 25 mm less than the radius of the cylinder. With that distance there is still enough current density at the edge of the disk so the copper plates to it. During the copper plating process the copper plates not only up to the edge of the disk, but starts forming a ledge over the whole thickness of the disk, possibly because the magnetic part of the disk is electrically conductive. Once the disk is pulled off, the ledge remains and forms a perfect starting point for the stripping of the Ballard shell.

Figure 1:
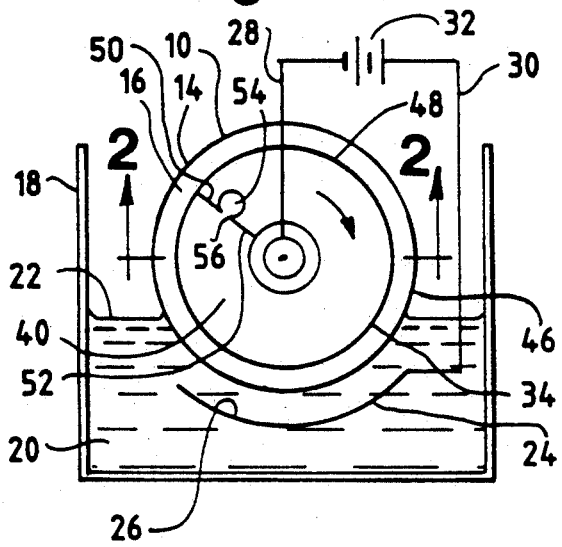
FIG. 1 is a schematic end elevational view of a gravure roll being plated in an electroplating tank according to the present invention.

Referring now in particular to the Figures, FIG. 1 shows a gravure roll 10 having an axis of concentricity 12, a substantially cylindrical outer surface 14, and side surfaces such as 16. The roll 10 is shown in the environment of an electroplating tank 18 containing a bath 20 of an electrolyte having a level surface 22. When the roll 10 is being plated, it is positioned relative to an anode 24 immersed in the electrolyte 20 so the concave inner surface 26 of the anode 24 is close to and generally concentric with the outer surface 14 of the roll 10.

In the assembly of FIG. 1, the roll 10 defines the cathode of the electroplating tank 18. Leads 28 and 30 respectively connect the roll 10 and the anode 24 to the corresponding terminals of a DC power supply 32.

The roll 10 is suspended with its axis 12 horizontal by suitable means, such as supports engaging the trunnion shafts 34 on each end of the roll. The roll 10 is dipped beneath the surface 22 of the electrolyte 20 so at least the bottom arc of the cylindrical outer surface 14 dips into the surface 22. In an under-shaft immersion tank (like the tank 18), the shafts such as 34 are suspended entirely above the surface 22. In a full immersion tank, the trunnion shafts 34 are supported beneath the surface 22, but the ends of the roll are sealed to isolate from the plating solution all of the roll assembly but the surface to be plated.

Figure 2:
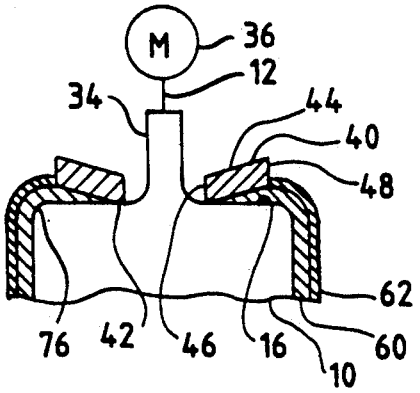
FIG. 2 is a fragmentary section taken along line 2—2 of FIG. 1 through the axis of the roll, showing the roll as it appears just before the Ballard shell is plated on the roll.
Figure 3:
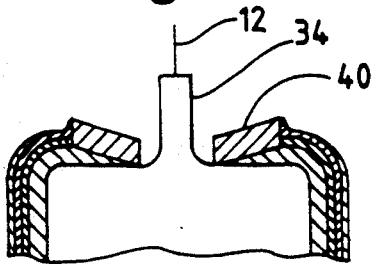
FIG. 3 is a view similar to FIG. 2, showing the roll just after the Ballard shell is plated on the roll.

The roll 10 is rotated by a motor schematically shown as 36 in FIG. 2 about its axis 12 during plating. Plating is evenly distributed about the circumference of the cylindrical outer surface 14.

What has been described so far is a conventional process for plating Ballard shells on gravure rolls and the like.

According to the present invention, the side surface 16 of the roll 10 is partially covered by a annular disk 40. Referring briefly to FIG. 2, the disk 40 is removably fixed to the side surface 16, and has first and second major surfaces 42 and 44, an inner circumference 46 defining an opening, and an outer circumference 48 defining a plating limit on the side surface 16 of the roll 10. The disk preferably has a substantially uniform thickness between its major surfaces 42 and 44. The outer periphery or circumference 48 of the disk 40 is substantially perpendicular to the major surfaces 42 and 44.

For plating in an under-shaft immersion tank such as 18, the disk 40 is sized, relative to the dimensions of the side surface 16 and the depth to which the roll 10 is dipped into the surface 22, so that the surface 22 lies entirely below the inner circumference 46 and above an arc of the outer circumference 48 of the disk 40. When the roll 10 is rotated about its axis 12, this depth of insertion ensures that the entire cylindrical outer surface 14 is plated, and also allows the outer circumference 48 of the disk 40 to define a plating limit on the side surface 16.

The disk 40 can be attached to the side surface 16 in various ways. For example, the disk can be clamped or otherwise fastened in place or an easily removed adhesive can be used for this purpose. However, in the preferred embodiment of the invention, the first major surface 42 of the disk 40 is cut from a flexible sheet of magnetic material, such as a commercially available flexible polymeric material having magnetic iron oxide particles therein.

This material has many commercial uses at present, among them utility as a flexible magnetic sign for temporary placement on an automobile door, as a self adhering tool rest for protecting the fender of an automobile during mechanical service, or as a material for making a currently popular novelty item known as a "refrigerator magnet". The inventor has found that this magnetic material is sufficiently adherent to the side surface 16 to retain the disk 40 in place while it is rotated in the electroplating tank 18.

The second major surface 44 of the disk 40 should be made of an electrically nonconductive material such as polyvinyl chloride or TEFLON (TEFLON is a registered trademark for polytetrafluoroethylene sold by E. I. DuPont de Nemours & Co., Wilmington, Del.). The second major surface 44, and to some degree the first major surface 42, should also be resistant to the copper electrolyte solution defined previously or any other copper electrolytes which are to be used.

More specifically, the nonconductive polymeric material should be resistant to attack by an aqueous solution containing from about 200 about 240 grams per liter of copper sulfate and from about 50 to about 65 grams per liter of sulfuric acid. The nonconductive polymeric material also preferably is resistant to chrome and degreasing electrolytes and printing inks. One material found to be a resistant to such chemicals is a polyvinyl chloride plastisol.

While not wishing to be bound or limited by his theory respecting the operation of his invention, the inventor believes that the second major surface 44 should be electrically nonconductive so that the plating defining the Ballard shell will not creep excessively over the surface 44 of the disk 40. (If the plating of the copper engraving layer 64 is thick, the plating has a greater tendency to creep in this manner.)

One suitable material for the disk 40 meeting these criteria is a 0.03 inch (0.76 mm.) thick laminate of a magnetic polymeric sheet and a white polyvinyl chloride sheet. The laminate is sold by Adams Magnetic Products, Chicago, Ill.

Different embodiments of the annular disk 40 are contemplated for the two roll handling systems which are currently in use. In one system, the roll 10 rests on its cylindrical outer surface 14 at some point, such as during storage, so the shaft 34 is not in contact with any support. If this system is in use, a solid annular disk 40 analogous to a washer can be used. The disk 40 is passed along the shaft 34 into direct contact with the side surface 16.

In the other roll handling system, the roll 10 is supported on its shafts 34 when the annular disk 40 is to be applied. In this situation, the annular disk 40 is provided with means to open it up so it can be wrapped about the shaft 34. Then the disk 40 is closed to retain it in place on the shaft 34.

FIG. 1 shows the embodiment of the annular disk 40 which is adapted to be opened for insertion about the shaft 34. In the disk 40 of FIG. 1, separable first and second edges 50 and 52 are defined by and substantially abut at a parting line extending from the inner circumference 46 to the outer circumference 48 of the disk 40. In this embodiment, the first edge 50 includes a tab 54 which is congruent with and interlocks in a recess 56 cut in the second edge 52.

The tab 54 and recess 56 define an interlock for releasably joining the first and second edges 50 and 52 in abutting relation at the parting line. This interlock is sometimes called a puzzle interlock herein because it resembles the joint between adjacent pieces of a jigsaw puzzle. While a non-interlocking coupling could also be devised, an interlocking coupling is preferred because it prevents the drag of the bath 20 during plating from stripping the disk 40 from the surface 16. The puzzle interlock does not unlock readily during a plating operation because the side surface 16 of the cylinder is flat, so the interlocked tab 54 and recess 56 are supported in the same plane and magnetically held in that plane. Either the tab 54 or the material defining the recess 56 must leave that plane, against the resistance of its magnetic attraction to the surface 16, to open the disk 40.

A non-interlocking joint in the disk 40 between its inner circumference 46 and its outer circumference 48 might suffice if the magnetic strength of the disk 40 is sufficient to resist stripping due to the rotation of the roll 10 about its axis 12. A spiral cut between the inner and outer circumferences 46 and 48 may improve the resistance of the disk to stripping. The disk 40 can also be taped to temporarily join its edges 50 and 52.

Referring now to in particular FIGS. 2–6, the process by which a Ballard shell is built on the roll 10 is illustrated. The layers and parts identified in the ensuing discussion are enlarged in FIG. 4 for greater clarity.

The layers formed on the cylindrical outer surface 14 of the roll 10 are the base copper layer 60, the separation layer 62, the copper engraving layer 64, and the chrome protective layer 66. The layers 64 and 66 together form the completed Ballard shell.

Figure 5:
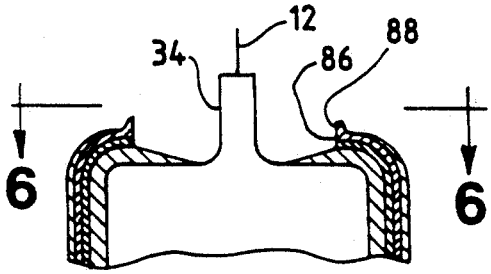
FIG. 5 is a view similar to FIG. 3, showing the roll after the annular disk shown in the previous Figures has been removed.
Figure 6:
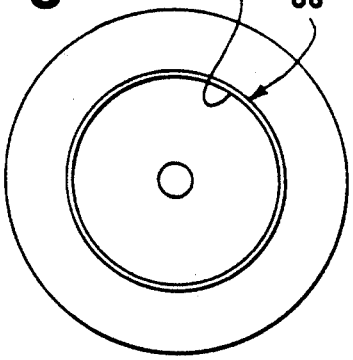
FIG. 6 is a schematic end elevation taken from line 6—6 of FIG. 4.
Figure 7:
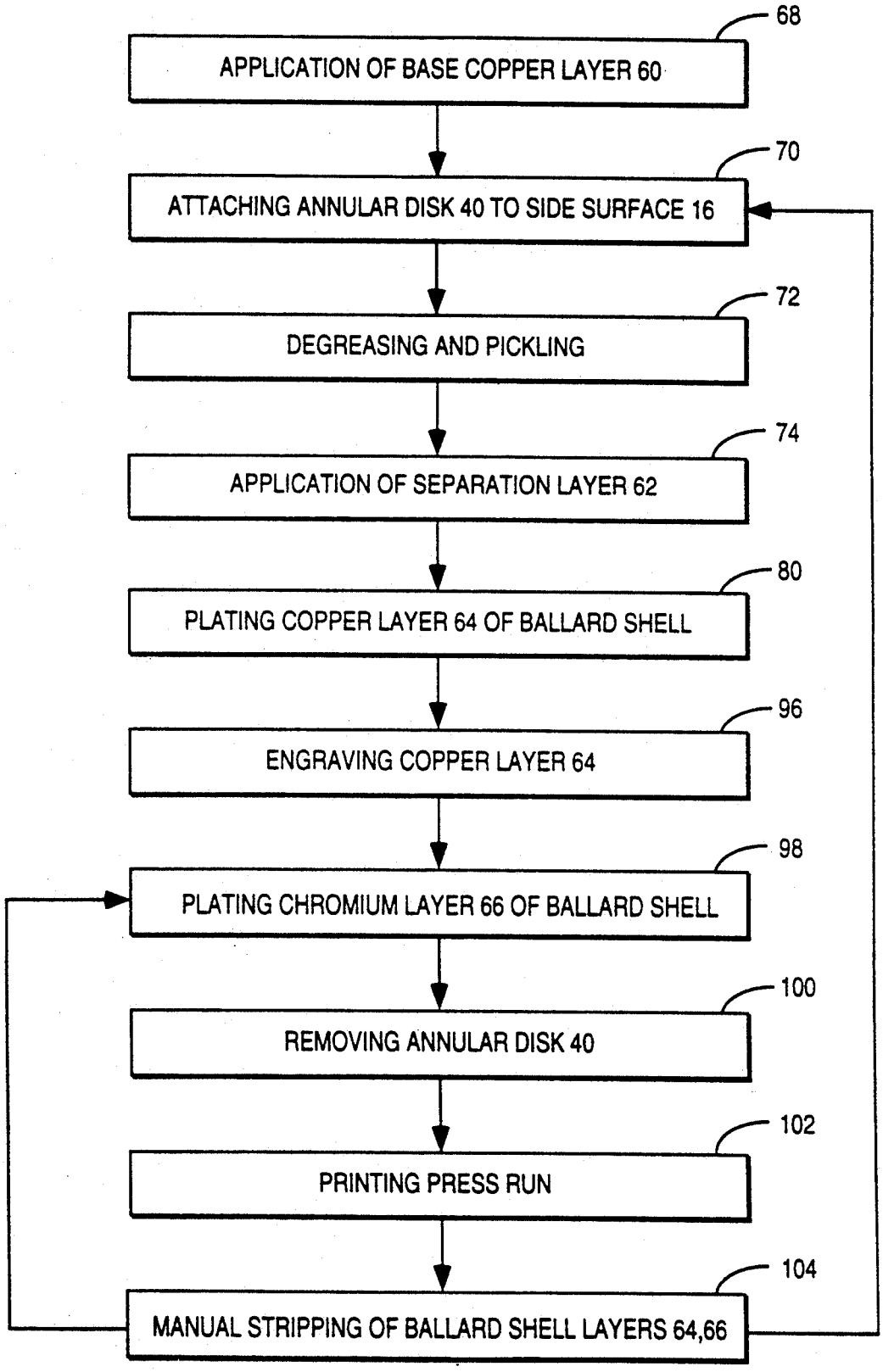
FIG. 7 is a schematic diagram of the steps employed to apply a Ballard shell to a gravure roll, use the roll for printing, strip the Ballard shell, and repeat the process, thereby recycling the roll. For brevity, some of the conventional details of the process are not illustrated.

FIGS. 2–6 show the series of steps, summarized in FIG. 7, by which the base copper layer 60 is applied, the Ballard shell layers 64 and 66 are applied, then the Ballard shell ultimately is stripped so the roll 10 can be recycled.

Figure 4:
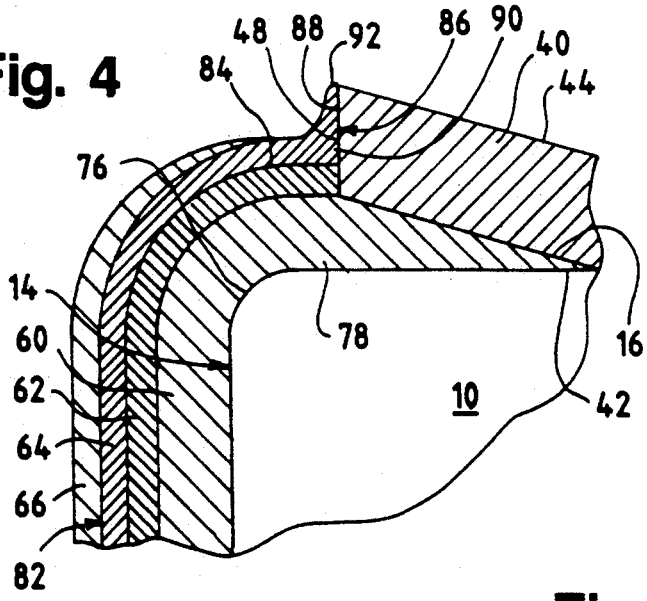
FIG. 4 is an enlarged detail view of FIG. 3.

Referring to FIG. 7, the base copper application step 68 is conventional, and is not repeated when the roll is recycled unless the existing base copper layer 60 has been damaged. FIG. 4 illustrates that the base copper 60 extends around the corner 76 of the roll 10 which is defined by the intersection between its cylindrical outer surface 14 and its side surface 16. The peripheral edge 78 of the base copper layer 60 is tapered because the greater the radial separation between a particular point on the side surface 16 and the anode 24, the thinner the base copper layer 60 will be plated at that point on the side surface 16.

The base copper layer 60 extends radially inward from the corner 76, although the exact radial extent of the peripheral edge 78 is not critical. The depth of immersion of the roll 10 beneath the surface 22 determines the degree to which the peripheral edge 78 will overlap the corner 76 of the roll 10.

The next step is attaching the annular disk 40 to the side surface 16, which is denoted in FIG. 7 as step 70. A disk 40 of suitable diameter to overlap the base copper layer 60 is used. If it has been necessary to disengage the tab 54 and recess 56 to install the disk 40, the tab 54 is inserted in the recess 56. The disk 40 is preferably attached before the degreasing and pickling step 72 and the step 74 of applying a separation layer 62 so these steps and the following plating steps can be carried out in an automated sequence without an interruption to remove the disk 40.

The degreasing and pickling steps 72 and the step 74 of applying a separation layer 62 are conventional. The separation layer 62 prevents adhesion between the engraving layer 64 and the base copper layer 60 so that the Ballard shell can later be stripped.

Referring particularly to FIG. 4, if the roll is processed without adapters and reels, the separation layer 62 extends over and envelops the peripheral edge 78 of the base copper layer 60 so that no contact between the layers 60 and 64 will be possible. (When a roll is processed with adapters and reels, the separation layer 62 extends to the reel only.) If the base copper 60 is plated further radially inward on the side surface 16, it may be possible for the separation layer 62 to stop short of the peripheral edge 78 and still provide separation between the layers 60 and 64.

Step 80 in FIG. 7 is plating the copper layer 64 of the Ballard shell. Referring briefly to FIG. 4, the copper engraving layer 64 plated on top of the separation layer 62 does not extend any further radially inward along the surface 16 than the inner periphery of the separation layer 62. The separation layer 62 therefore completely isolates the layers 60 and 64 and also isolates the layer 64 from the surface 16.

Referring again to FIG. 4, the copper portion 64 of the Ballard shell has a cylindrical portion generally indicated at 82 overlying the outer surface 14 of the cylinder 10, a substantially annular intermediate portion 84 overlying the side surface 16 of roll 10 from the cylindrical portion 82 to an inner circumference 86, and an axially extending ledge portion 88 having a first end 90 which is integral with the inner circumference 86 and a second end 92 extending axially outward from the inner circumference 86. The axially extending ledge portion 88 abuts the outer circumference 48 of the disk 40.

Figure 8:
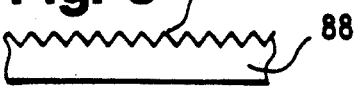
FIG. 8 is a fragmentary elevation taken from the line 8—8 of FIG. 6, showing the sawtooth edge of a Ballard shell made according to the present invention.

Referring to FIGS. 5, 6 and 8, the exposed edge of the ledge portion 88 here has a sawtooth configuration made up of fingers such as 94 of plating which are integral with and extend axially outward from the inner circumference 86. The fingers 94 are crystalline extensions of the plating 64. While not intending to be bound by his theory of how the invention works, the inventor believes that the offset sawtooth edge of the ledge 88 results because the outer circumference 48 of the magnetic layer of the disk 40 is somewhat electrically conductive, while the backing of the disk 40 is an insulator. The plating can thus grow away from the surface 16 along the edge of the magnetic layer, but the plating tends not to grow radially inward over the second major surface 44 unless the plating is thick. Fingers form because the plating 64 serves as a better cathode than the surface 44 for the fingers 94.

After the copper layer 64 of the Ballard shell is fully plated, as in step 80 of FIG. 7, its outer cylindrical surface is finished by polishing it. When the surface layer 64 has been adequately prepared, it is engraved with the impressions desired for printing in the step 96. The engraved copper layer 64 is then plated over with a very thin protective layer 66 of chromium which is not thick enough to appreciably distort the engraved surface of the layer 64. The disk 40 may remain in place during this step, shown in FIG. 7 as step 98. After the usual final preparation of the chrome layer 66, the roll 10 is ready for use in a rotogravure printing press for producing printed impressions, as in printing a web of paper.

The disk 40 may be removed from the roll 10 at different stages. In the embodiment illustrated in FIG. 7, the disk removing step 100 is carried out after the chrome plating step 98 and before the printing press run 102. Alternatively, the disk 40 can be removed after the copper plating step 80, or after the printing press run 102.

In the latter variation, the disk 40 is removed when it is desired to manually strip the Ballard shell from the roll 10. If this embodiment is followed, the disk 40 should be made of TEFLON or another material which will resist toluene, xylene, oils, and any other solvents and chemicals used in the press room or as an ingredient of ink. TEFLON is also heat resistant, and thus will stand up to any elevated temperatures it may experience.

Whenever the disk 40 is removed, it can be removed easily because the copper plating does not adhere tightly to it and its magnetic strength is modest at any particular point.

If a long printing press run is necessary, the roll 10 can be renewed without removing the copper layer 64 by selectively removing the chrome layer 66, then replating the chromium layer 66, preferably with the disk 40 in place. When the chrome layer 66 has been replaced, the roll 10 is returned to service in a second printing press run 102. This renewal step is illustrated by the recycle arrow on the left side of FIG. 11, connecting the steps 102 and 98. This feature is conventional.

When all the press runs 102 have been completed, the Ballard shell is manually stripped according to the step 104 shown in FIG. 7. A Ballard shell having the axially extending ledge portion 88, which is novel, is more easily removed from the roll 10 than a conventional Ballard shell which has a peripheral edge smoothly tapered or feathered into the surface 16. A putty knife slid radially outward along the surface 16 easily engages the ledge 88, so a considerable parting force can be applied on the inner circumference 86.

The stripping step 104 is further facilitated by the present invention because the crotches between the fingers 94 of the sawtooth edge on the ledge portion 88 define logical fracture lines for splitting the plating.

Once the Ballard shell layers 64 and 66 are stripped according to the step 104, the roll can be recycled to the steps 70 and following of FIG. 7, as illustrated by the recycle arrow on the right side of that Figure.

Although the Ballard shell is easily removable, the shell will not slough from the cylinder while the shell remains whole, partly because the shell overlaps the sides 16 of the roll 10, and partly because it adheres to some degree to the separation layer 62.

It should be appreciated that the process shown in FIG. 7 has been simplified for the sake of clarity, particularly as to details which are not novel. Certain steps can be performed in a different order than the illustrated sequence.

Since the sawtooth edge of the axially extending ledge portion 88 could conceivably provide a hazard while the roll 10 is handled during production, in the press room, and otherwise, it may be desirable to finish the saw tooth edge by grinding it sufficiently to dull it. This degree of grinding need not interfere with removal of the Ballard shell from the roll 10 after the press run is complete.

To summarize, an improved method of forming a Ballard shell, a novel Ballard shell construction, and a printing roll including this novel Ballard shell construction have been described. The Ballard shell of the present invention is easier to remove than prior Ballard shells. The annular disk used to cover the sides of the cylinder 10 during the application of the Ballard shell is also believed to be novel, particularly when it includes a puzzle interlock.

What is claimed is:

1. A Ballard shell comprising a metal body which is thin enough to be manually stripped from a support, said body having a substantially cylindrical portion, a substantially annular intermediate portion extending inwardly in a generally radial plane from said cylindrical portion to an inner circumference, and a ledge portion having a first end substantially integral with said inner circumference and a second end extending axially away from said cylindrical portion.

2. A Ballard shell having a cylindrical portion, a substantially annular intermediate portion extending inwardly in a generally radial plane from said cylindrical portion to an inner circumference, and an axially extending ledge portion having a first end substantially integral with said inner circumference and a second end extending axially away from said cylindrical portion, wherein said ledge portion has a sawtooth edge comprising integral fingers of plating which extend axially away from said cylindrical portion.

3. A roll comprising a substantially cylindrical outer surface; a side surface; and a Ballard shell made of metal and thin enough to be manually stripped from said cylindrical outer surface and said side surface; said Ballard shell having:

A. a cylindrical portion overlying the outer surface of said cylinder,

B. a substantially annular intermediate portion overlying the side surface of said roll from said cylindrical portion to an inner circumference, and C. at least one axially extending ledge portion having a first end substantially integral with the inner circumference of said intermediate portion and a second end extending axially away from said cylindrical portion.

4. A roll comprising:

A. a substantially cylindrical outer surface;

B. a side surface which is capable of attracting a magnet;

C. a Ballard shell made of plated metal and having a cylindrical portion overlying the outer surface of said cylinder, a substantially annular intermediate portion overlying the side surface of said roll from said cylindrical portion to an inner circumference, and at least one ledge portion having a first end substantially integral with the inner circumference of said intermediate portion and a second end extending axially away from said cylindrical portion; and D. a separable annular disk having a first major surface abutting and magnetically adhering to said side surface, a second major surface, an inner circumference defining an opening, and an outer circumference, wherein the inner circumference of said axially extending ledge abuts the outer circumference of said disk.

5. A roll comprising a substantially cylindrical outer surface; a side surface; and a Ballard shell made of plated metal; said shell having:

A. a cylindrical portion overlying the outer surface of said cylinder,

B. a substantially annular intermediate portion overlying the side surface of said roll from said cylindrical portion to an inner circumference, and C. at least one ledge portion having a first end substantially integral with the inner circumference of said intermediate portion and a second end extending axially away from said cylindrical portion, wherein said ledge portion has a sawtooth edge comprising integral fingers of plating which extend axially away from said cylindrical portion.

* * * * *